United States Patent [19]

Imai et al.

[11] 3,990,813

[45] Nov. 9, 1976

[54] APPARATUS FOR TYING MOVING BLADES

[75] Inventors: Tetsu Imai; Kazuo Ikeuchi, both of Hitachi, Japan

[73] Assignee: Hitachi, Ltd., Tokyo, Japan

[22] Filed: Nov. 27, 1974

[21] Appl. No.: 527,879

[30] Foreign Application Priority Data

Nov. 30, 1973 Japan ..... 48-133480

[52] U.S. Cl. ..... 416/196 R

[51] Int. Cl.² ..... F01D 5/22

[58] Field of Search ..... 416/195, 196, 190, 191

[56] References Cited

UNITED STATES PATENTS

| | | | |
|---|---|---|---|
| 1,423,466 | 7/1922 | Snyder | 416/191 UX |
| 1,469,901 | 10/1923 | Gilson | 416/196 X |
| 1,554,614 | 9/1925 | Allen | 416/190 |
| 2,942,843 | 6/1960 | Sampson | 416/190 |
| 3,396,905 | 8/1968 | Johnson | 416/190 X |
| 3,451,654 | 6/1969 | Johnson | 416/196 X |
| 3,719,432 | 3/1973 | Musick et al. | 416/196 |
| 3,728,044 | 4/1973 | Fujita et al. | 416/196 X |
| 3,752,599 | 8/1973 | Pace | 416/196 X |

FOREIGN PATENTS OR APPLICATIONS

| | | | |
|---|---|---|---|
| 1,374,917 | 8/1964 | France | 416/196 |
| 69,842 | 12/1958 | France | 416/196 |
| 1,426,798 | 3/1969 | Germany | 416/196 |
| 128,868 | 1960 | U.S.S.R. | 416/196 |

*Primary Examiner*—Everette A. Powell, Jr.
*Attorney, Agent, or Firm*—Beall & Jeffery

[57] ABSTRACT

The annular array of radially extending blades on the rotor of a rotary fluid machine are tied together at generally their mid portions by interlocking separate tying members and projection pairs, wherein each projection pair includes facing projections on adjacent blades of the array. The tying members and projections have mating bearing surfaces that will provide a tangential force as a result of wedging produced by the centrifugal force acting upon the tying members during rotation of the rotor at rated speed, without restraining individual twisting of the blades about their radial extent.

5 Claims, 9 Drawing Figures

APPARATUS FOR TYING MOVING BLADES

BACKGROUND OF THE INVENTION The present invention relates to apparatus for tying blades of fluid machinery, particularly turbine blades, intermediate the ends thereof to restrain tangential vibration of the blades.

Generally, the natural frequency of the blades in the tangential direction is the lowest in the various vibration modes and correspondingly has the greatest effect on the moving blades. Therefore, it is desirable to restrain or dampen the tangential vibration of the moving blades.

Apparatus is known to restrain tangential vibration by tying the moving blades together, but members are disposed between the blades and welded to the blades. Such apparatus has the danger that the moving blades will crack at the welding portions due to the vibration of the moving blades.

Other apparatus is also known wherein a sleeve is inserted into a boss provided on each of the opposite surfaces of the blades, so that surface friction applied between the sleeve and the boss by centrifugal force of the sleeve due to rotation of the sleeve dampens the vibration of the moving blades. In this apparatus, there is not enough surface friction to satisfactorily dampen the vibration. Further, the apparatus will prevent the free twisting movement between the sleeve and the boss, because the boss moves in a direction traversing insertion of the boss into the sleeve with the moving blade itself rotated to produce centrifugal force.

SUMMARY OF THE INVENTION

It is an object of the present invention to provide apparatus for tying together the blades of a fluid machine for the prevention of tangential vibration while providing for high reliability. Also, it is a further object to restrain such tangential vibration without restraining the twisting movement of the individual blades.

These objects are accomplished by means of a plurality of tying members respectively disposed between adjacent blades of an annular array, with engaging and mating bearing surfaces between projections on the blades and the opposite ends of the tying members, so that the blades will be interbraced due to the centrifugal forces applied to the tying members, without restraining twisting movement of the blades during rotation of the blades at the rated speed.

The interbracing is accomplished by means of wedging portions of bearing surfaces that will convert the centrifugal force on the tying member into tangential forces between the tying members and the blades.

Further objects, features and advantages of the present invention will be understood from the following description of the preferred embodiments of the accompanying drawing.

DESCRIPTION OF THE PREFERRED EMBODIMENTS

Figure 1:
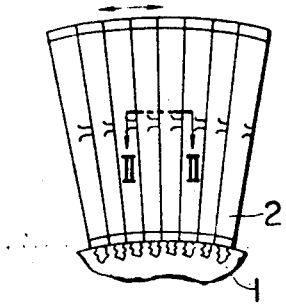
FIG. 1 is a schematic front view, looking in the axial direction, of a turbine rotor portion employing the features of the present invention for tying together the blades.

In the present invention, the adjacent blades of an annular array of radially extending blades are tied together between their radially outer and inner ends. In FIG. 1, only a portion of the rotor of a rotary fluid machine is shown, since the rotor may be of any conventional type employing an annular array of radially extending blades. While the tying apparatus applies to any such annular array of blades, the following embodiments specifically relate to turbine rotors, for purposes of illustration.

In FIG. 1, a turbine rotor hub 1 (only partially shown), rotates within the plane of FIG. 1. The hub 1 is provided with an annular array of radially extending turbine blades 2, which blades 2 may have their outer ends free or connected as is conventional with such blading and their inner ends individually connected to the hub 1 by means of a conventional dovetail connections. The blades 2 are mounted to extend radially from the axis of rotation and rotate with the hub about the axis of rotation due to the kinetic energy of the fluid applied thereto when operating as a turbine. One of the various vibration modes occurring in such an array of blades is in the tangential direction as shown by the double headed arrow above the blading. Apparatus for tying together the blades is employed between the inner end and the outer end of each of the blades 2, preferably at a portion a little more than half the length of each blade 2 from the inner end thereof.

The embodiment of the tying apparatus that is shown in FIGS. 2A, 3, 4 and 5 comprises projections 3 provided on the back portions of each of the blades 2, projections 4 provided on the back portions of each of the blades 2 and adjacent projections 3 on the back portions, and tying members or rods 5 operatively disposed between adjacent projections 3, 4, which adjacent projections of adjacent blades form projection pairs, so that the number of tie rods 5 equal the number of such projection pairs.

Figure 5:
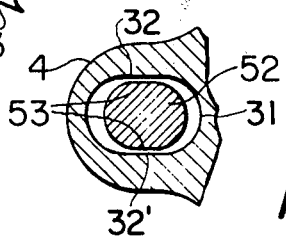
FIG. 5 is a partial cross sectional view taken along line V—V of FIG. 4, that is in a plane passing through the axis of rotation.

Each of the projections 3 has a recess 30 for receiving therein one end of the elongated tie rod 5, and correspondingly each of the projections 4 has a recess 40 similar to the recess 30 for receiving the opposite end of the tie rod 5 therein. For each projection pair, the recesses 30 and 40 are substantial mirror images of each other, so that a full description of only one will suffice, and correspondingly the opposite ends of the tie rod 5 are substantially identical. The recess 30, as shown in FIG. 5, is provided with opposite arcuate side walls 31 that extend over into opposite top and bottom planar side walls 32, 32' respectively. The side walls 31, 32, 32' of the recess 30 are formed by a straight line 33, 37 parallel to the plane of rotation moving in the closed path locus shown in FIG. 5. The recess 30 is further defined by an end wall shown in FIG. 3 as comprising an arcuate portion 34 of the same radius as the arcuate portion 31 of FIG. 5 that extends from the straight line 33 to a straight line 35 that is perpendicular to the plane of rotation, and an arcuate portion 36 of the same radius of curvature as the portions 31 and 34, and extending between lines 35 and 37. As a result, a portion of a sphere is defined by the curved end wall portion 34 that extends along the adjacent arcuate portion 31, and a second spherical portion is formed by the arcuate portion 36 extending along the adjacent opposite arcuate portion 31. The remainder of the recess 30 is defined by a chamfered peripheral portion 38 as the inlet joins with the side walls.

Figure 3:
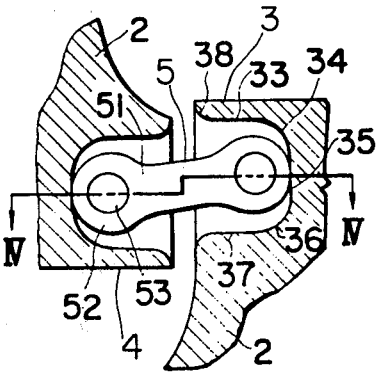
FIG. 3 is an enlarged portion of FIG. 2A, in greater detail.
Figure 4:
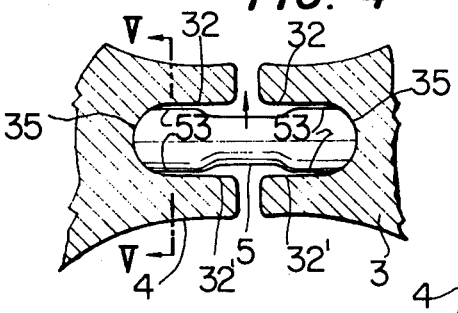
FIG. 4 is a partial cross sectional view taken along line IV—IV of FIG. 3, that is in the plane of rotation of the blades.

The recess 30 is aligned with the opposite recess 40, with respect to the radial direction as shown in FIG. 4, that is, they are at the same radius from the axis of rotation; however, the recess 30 is misaligned or eccentric with respect to the recess 40 with respect to the axial direction, as shown in FIG. 3.

Each of the tie rods 5 comprises a rod portion 51 and opposite generally spherical end portions 52. Each of the spherical end portions is of substantially the same radius as the arcuate portions 31, 34, 36, and further the radially outermost and innermost portions of the spherical end portions are removed to form planar surfaces 53 that are parallel to the planar surfaces 32, 32' of the associated recess. The above mentioned side wall and end wall surfaces of the recesses 30, 40, and the spherical end portions and planar portions 53 of the tie rods form mating bearing surfaces. Each of the tie rods 5 is inserted in the recesses 30 and 40 of a projection pair so that both ends of the tie rods 5 are in contact with the respective end faces 35 of the recesses 30 and 40, but with radial clearance as shown in FIG. 4 between the surfaces 32, 32' and 53, and with axial clearance between the bearing surfaces as shown in FIG. 3, which clearances are also both shown in FIG. 5. The drawing shows the blades and tie members in their normal position when the rotor is at rest.

Figure 2A:
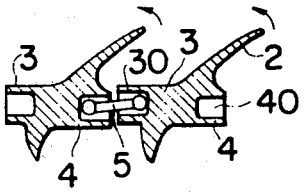
FIG. 2A is a cross sectional view taken through two blades along the line II—II of FIG. 1 in a plane tangential to the axis of rotation of one embodiment of the present invention.

When the turbine is rotating at its rated speed, the tie rods 5 will be displaced radially outward as shown by the arrow in FIG. 4, due to the centrifugal forces thereon, and at the same time, the moving blades 2 each are twisted by the fluid kinetic energy and centrifugal forces about respective radial axes as shown by the arrows in FIG. 2A. Such twisting of each of the blades will result in relative axial movement between the opposite recesses 30 and 40, so that the opposite recesses 30 and 40 if viewed in a cross section similar to FIG. 3 during rotation would be aligned. The displacement of the tie rod 5 radially outward due to the centrifugal forces will produce tangential forces on the projections 3 and 4 due to the wedging contact between the spherical portion 52 of the tie rods 5 and the cylindrical portions shown in FIG. 4 formed by the straight line 35 moving on the semicircular locus of FIG. 4, as the planar surfaces 53 and 32 move toward each other, which will all result in interbracing between projections 3, 4 and tie rods 5 for the blades 2. Because of this interbracing due to the wedging action of the tie rods 5 between the adjacent front and back portions of the blades, a tangential force or vibration applied to any one of the plurality of moving blades 2 will be transmitted to all of the moving blades 2 through the tie rods 5 and projections 3, 4. That is, all the moving blades 2 are tied together at generally their mid portions by the tying apparatus of the present invention, so that vibration of any one blade 2 is restrained by all of the blades. The planar portions 53, 32, 32' of the tie rod 5 and the projections 3, 4 are for preventing the tie rod 5 from rotating about its axis of elongation, and further the radially outer planar surfaces 32 cooperate with the radially outer planar surfaces 53 to serve as an abutment for radial outer movement of the tie rods 5 due to centrifugal force. When the movement of the tie rods radially outward due to centrifugal force is stopped by the planar portions 32, tangential vibration of the moving blades 2 are dampened by frictional forces between the planar surfaces 32, 53 resulting from the radial centrifugal force of the tie rod 5 acting on such frictional surfaces, in addition to the above mentioned interbracing effect. Further, alignment of the recess 30, 40 due to the above mentioned twisting of the blades will have an inherent wedging effect.

Figure 2B:
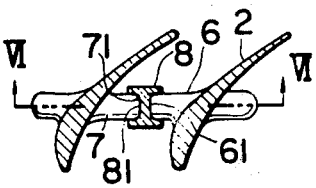
FIG. 2B is a view similar to FIG. 2A and taken along line II—II of FIG. 1 of a second embodiment according to the present invention.
Figure 6:
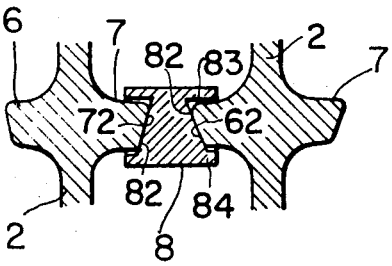
FIG. 6 is an enlarged partial cross sectional view taken along line VI—VI of FIG. 2B, that is in the plane of rotation.

The second embodiment of the present invention as shown in FIGS. 2B and 6 will be described in less detail than the first embodiment because it is quite similar in structure and function, and the following description will relate primarily to the differences between the two embodiments. Adjacent blades have projections 6 and 7 opposite each other, with tying members 8 therebetween. Each of the projections 6, 7 has a rounded terminal end shape 61, 71, respectively, as shown in the tangential plane of FIG. 2B, and wedging surface shape 62, 72 as shown in the plane of rotation of FIG. 6, to form the bearing surfaces that are for the projections. Each of the tie members 8 comprises a body portion 84, with opposite bearing surfaces 82 correspondingly shaped to mate with the above mentioned bearing surfaces of the projections 6, 7, respectively, and a surrounding portion 83, which periphery surrounds the end portions of the projections 6, 7 with clearance. The surrounding portion 83 on its inside and outside surfaces, of the tie member 8, may be generally cylindrical or quadrangular.

During operation of the apparatus shown in FIGS. 2B and 6, the rounded faces 61 and 71 permit twisting movements of the blades 2 freely except for the restriction due to the friction forces between the tie member 8 and the projections 6, 7. Also during rotation of the rotor, interbracing forces due to the centrifugal forces acting upon and outwardly moving the tie member 8 are created by the wedging surfaces 62, 82 and 72, so that the centrifugal force in the radial direction will produce tangential components due to the cooperating wedging bearing surfaces 62, 72, 82 of the tie member 8 and the projections 6, 7 in contact with the tie member 8. The remaining structure and function of the second embodiment is similar to the first embodiment.

Figure 2C:
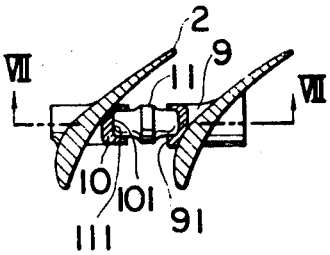
FIG. 2C is a cross sectional view similar to FIG. 2A and taken along line II—II in FIG. 1 of a third embodiment according to the present invention.
Figure 7:
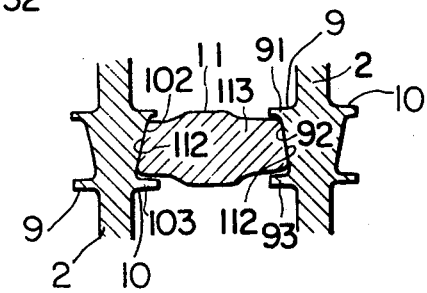
FIG. 7 is a partial enlarged cross sectional view taken along line VII—VII of FIG. 2C, that is in the plane of rotation.

The third embodiment of the present invention is shown in FIGS. 2C and 7, and since its structure and function is similar to the previously described embodiments, only the differences will be discussed in detail. The projections 9 and 10 opposite each other on adjacent blades 2 cooperate with tie members 11. Each of the projections 9, 10 has a recess at its terminal end for receiving therein the opposite ends of the tie member 11. The opposite recesses have bearing faces 91, 101, respectively for cooperating with the end portions 111 of the tying member 11. The bearing surfaces 91, 101 are arcuate in the tangential plane as shown in FIG. 2C for accommodating blade twisting, and are wedged shape along line 92, 102 as shown in the plane of rotation of FIG. 7 for producing the wedging action as the tying member 11 moves radially outward due to centrifugal forces. The recesses of the projections 9, 10 have surrounding side walls 93, 103, that will retain, with clearance, the tie members 11 to prevent them from falling out of the recesses of the projections 9, 10. Each of the tie members 11 has end bearing portions 112 on its opposite ends 113, which are formed complimentary to and for mating with the corresponding bearing surfaces of the recesses of the projections 9, 10. The wedging shape 92, 102, of the bearing surfaces are inclined in FIG. 7 so that as the tying member 11 is displaced radially outward due to the centrifugal force, the blades 2 will be interbraced with respect to each other as described above with respect to the previous embodiments. The arcuate shape of the bearing surfaces 91, 101 of the projections and the corresponding arcuate shape of the tying member 11 at 111 permit free twisting movements of the blades 2, except for the restaint provided by the frictional forces between the bearing surfaces.

The projections 3, 4, 6, 7, 9 and 10 each are a part of the corresponding blades 2 and are formed thereon preferably by profile cutting with a profile cutting machine. The tying members 5, 8 and 11 are separate from the blades and each formed by machining, preferably. Also, the tying members may be formed by precision casting. Further, it is contemplated that the recesses in the projections or the typing members themselves may be formed by electric discharge machining.

With respect to all of the embodiments, it is seen that cooperating tying members and recesses have bearing surfaces that increase in tangential spacing from each other towards the axis of rotation so that radial outward movement of the tying members will produce a wedging action to tightly interbrace the mid portions of the blades. Further, normal twisting action of the blades will be permitted by the arcuate shape of the bearing surfaces as seen in a tangential plane for all of the embodiments. Further, the difference in shape of the bearing surfaces in the two mutually perpendicular tangential and rotation planes will resist rotation of the tying member about an axis extending between the projections for all of the embodiments. Further, the alignment of the recesses caused by the twisting of the blades will inherently produce a wedging action to further interbrace the blades for all of the embodiments.

While several embodiments of the present invention have been set forth in detail for purposes of description and with respect to their advantageous details, further embodiments, variations and modifications are contemplated according to the broader aspects of the present invention, all as determined by the spirit and scope of the following claims.

What is claimed is:

1. In a rotary fluid machine having a rotor with an annular array of generally radially extending blades with radially inner and outer ends, the improvement being in apparatus for tying the blades together between their inner and outer ends, comprising: said blades having a plurality of pairs of projections, each pair of projections consisting of a first projection provided on one of said blades and a second projection provided on the adjacent blade in facing relationship with respect to said first projection, each of said first projections having a bearing surface and each of said second projections having a bearing surface facing the bearing surface of said first projection of said pair, and at least part of said bearing surfaces of each pair increasing in tangential distance from each other toward the axis of rotation; a plurality of tying members separate from said blades and corresponding in number to the number of said pairs of projections, each of said tying members extending between the bearing surfaces of a corresponding pair of projections, each of said tying members having bearing surfaces at their opposite ends of mating shape with the corresponding bearing surfaces of said first and second projections, and each of said tying members being mounted for limited radial movement outwardly with respect to its adjacent blades; said mating bearing surfaces engaging each other around the entire annular array of said blades during rotation of the rotor to provide wedge means for applying tangential forces between adjacent blades resulting from the centrifugal forces acting upon and radially outwardly moving said tying members to interbrace the blades tangentially around the array at a predetermined speed of the rotary fluid machine and restrain tangential vibrations; at least the cooperating first projections and adjacent ends of the tying members associated therewith having means positively restraining rotation of the tying member about a line drawn between its opposite bearing surfaces; said engaging bearing surfaces of said projections and tying members being at least partly arcuate in shape as viewed in a tangential plane passing through them for each pair to provide means for permitting relative axial movement between the adjacent projections of each pair of projections as caused by twisting of each blade about its radial extent; the bearing surfaces for each of said tying members including spherical portions and at least one planar portion that is perpendicular to the radial direction, and each of said projections having a recess receiving therein said spherical portions and said planar portion of the tying member with substantial clearance at least in the radial direction for said planar portion when the rotor is at rest; said recesses and planar portions at least in part constituting said means restraining motion.

2. The apparatus of claim 1, wherein said recess and said tying member bearing surfaces have substantial play in a direction parallel to the axis of rotation.

3. The apparatus of claim 2, wherein the bearing surfaces for each of said recesses have spherical portions of substantially the same radius as and for correspondingly engaging in the spherical portions of said tying members.

4. The apparatus of claim 1, wherein the bearing surfaces for each of said recesses have spherical portions of substantially the same radius as and for correspondingly engaging the spherical portions of said tying members.

5. The apparatus of claim 1, wherein each of said recesses includes a planar portion that is perpendicular to the radial direction and facing the adjacent tying member planar portion with a substantial radial space therebetween when the rotor is at rest, and the adjacent planar portions of said recesses and tying members being in frictional contact at the predetermined speed to dampen, tangential vibration of the moving blades when the rotor is at the predetermined speed.

* * * * *